US009485587B1

(12) United States Patent
Skramstad et al.

(10) Patent No.: US 9,485,587 B1
(45) Date of Patent: Nov. 1, 2016

(54) SPEAKER DEVICE ASSEMBLY WITH RECOIL VIBRATION ATTENUATING COUNTER BALANCE

(71) Applicant: Cisco Technology, Inc., San Jose, CA (US)

(72) Inventors: Rune Skramstad, Drammen (NO); Øivind Stuan, Akershus (NO); Kevin Lee Hughes, Richardson, TX (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 13 days.

(21) Appl. No.: 14/693,723

(22) Filed: Apr. 22, 2015

(51) Int. Cl.

| | |
|---|---|
| ***H04R 9/06*** | (2006.01) |
| ***H04R 9/04*** | (2006.01) |
| ***H04R 3/00*** | (2006.01) |
| ***H04R 9/02*** | (2006.01) |

(52) U.S. Cl.
CPC ..... *H04R 9/043* (2013.01); *H04R 3/002* (2013.01); *H04R 9/025* (2013.01); *H04R 9/046* (2013.01); *H04R 9/063* (2013.01); *H04R 2209/041* (2013.01)

(58) Field of Classification Search
CPC ..... H04R 1/403; H04R 3/002; H04R 3/08; H04R 7/20; H04R 9/025; H04R 9/043; H04R 9/046; H04R 9/06; H04R 9/063; H04R 2209/041; H04R 2209/043
USPC ..... 381/96, 117, 182, 396, 400, 401, 402, 381/403, 404, 405, 407, 409, 410, 412, 418
See application file for complete search history.

(56) References Cited

U.S. PATENT DOCUMENTS

| | | | | |
|---|---|---|---|---|
| 5,197,104 | A * | 3/1993 | Padi | H04R 3/002 381/401 |
| 5,832,096 | A | 11/1998 | Hall | |
| 6,404,896 | B1 | 6/2002 | Yoo et al. | |
| 6,778,677 | B2 * | 8/2004 | Coffin | H04R 9/045 381/401 |
| 7,848,536 | B2 | 12/2010 | Sadaie et al. | |
| 7,856,115 | B2 * | 12/2010 | Clair | H04R 1/403 381/398 |
| 8,335,336 | B2 | 12/2012 | Kuze et al. | |
| 2006/0104472 | A1 | 5/2006 | Abe et al. | |

* cited by examiner

*Primary Examiner* — Huyen D Le
(74) *Attorney, Agent, or Firm* — Polsinelli PC

(57) ABSTRACT

In one embodiment, a speaker device assembly includes a first voice coil assembly moveable along an axis of a magnetic field of a magnetic core responsive to an induced current to facilitate pressure variations in a medium, and cause recoil vibration on a speaker device assembly structure. The speaker device assembly further includes a second voice coil assembly having a counter balance mass that accounts for at least a mass of the first voice coil assembly, and moveable along the axis of the magnetic field in a direction opposite the first voice coil assembly to attenuate the recoil vibration on the speaker device assembly structure, when the first voice coil assembly moves along the axis of the magnetic field.

20 Claims, 10 Drawing Sheets

SPEAKER DEVICE ASSEMBLY WITH RECOIL VIBRATION ATTENUATING COUNTER BALANCE

TECHNICAL FIELD

The present disclosure relates generally to acoustic devices, and more specifically to improved noise attenuation, including noise caused by recoil effects, for speaker device assemblies.

BACKGROUND

Widespread access to various types of multi-media data is facilitated, in part, by advances in communication technologies. Increasingly, consumer preferences, when accessing such multi-media, highlights a demand for quality, portability, and the like, and supports a marketplace for smaller, lighter, portable, as well as integrated acoustic devices. However, design choices for these acoustic devices typically balance size (e.g., form factor, portability, etc.) against sound quality, which may result in poor overall acoustic quality. For example, certain acoustic devices having reduced form factors typically include speaker drivers that move diaphragms (e.g., to produce sound, etc.), but also transfer vibration to structural elements or housings (e.g., recoil vibration), which causes unwanted noise (e.g., an undesired frequency response, rattling, knocking, etc.). Further, this vibration can interfere with other noise cancellation features (e.g., acoustic echo, etc.), and may even reduce an overall operable lifetime of the underlying acoustic device (e.g., additional vibration produces stress on various components, etc.). Moreover, conventional approaches to reduce or attenuate the unwanted vibration typically include overly complex designs (e.g., including various components such as gaskets, rubber bushings, and extensive use of bracing, etc.). Further other conventional approaches such as those incorporating dual motors, dual radiators, and the like, attenuate or reduce vibration for only a limited or specific frequency of vibration.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

An element or functionally similar component is indicated with the same reference number.

DESCRIPTION OF EXAMPLE EMBODIMENTS

Overview

The present disclosure provides improved noise attenuation techniques and designs for acoustic devices such as speaker device assemblies. For example, according to one or more embodiments of the disclosure, a speaker device assembly includes a first voice coil assembly moveable along an axis of a magnetic core responsive to an induced current to facilitate pressure variations in a medium (e.g., sound waves in an air medium, etc.) and cause recoil vibration on a speaker assembly structure. To attenuate the recoil vibration on the speaker assembly structure, the speaker device assembly further includes a second voice coil assembly having a counter balance mass that accounts for at least a mass of the first voice coil assembly, and moveable along the axis of the magnetic core in a direction opposite to a direction of the first voice coil assembly. In this fashion, the second voice coil assembly attenuates the recoil vibration on the speaker assembly structure (e.g., caused by a recoil force from the first voice coil assembly) when the first voice coil assembly moves along the axis of the magnetic core. Put differently, forces from the two opposed voice coil assemblies provide harmonically balanced differential vibration cancellation for the recoil force in an electrodynamic transducer, which cancels re-radiation of unwanted audio noise through and from the speaker device assembly (e.g., a loudspeaker enclosure, etc.).

DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

As discussed above, certain acoustic devices typically include a speaker driver that produces sound, but may also cause undesirable vibration to an acoustic device structure or housing resulting in noise. This undesirable vibration is particularly problematic for acoustic devices that have smaller (e.g., reduced dimension, reduced form factor, etc.) acoustic assemblies such as video endpoints, IP-phones, tablets, TVs, cellphones, other stand-alone portable acoustic devices, and the like. Specifically, these acoustic devices typically include multi-component assembly designs and also have less mass—the combination of which fails to attenuate structural vibration (e.g., recoil vibration, etc.).

Accordingly, as discussed herein, the present disclosure provides generally speaker devices and assemblies that including two voice coils movable in opposing directions, with one of the two voice coils having a counter balance mass that attenuates structural vibration in the speaker device assembly. Such structural vibration can be caused, for example, by recoil forces of a voice coil assembly.

Figure 1:
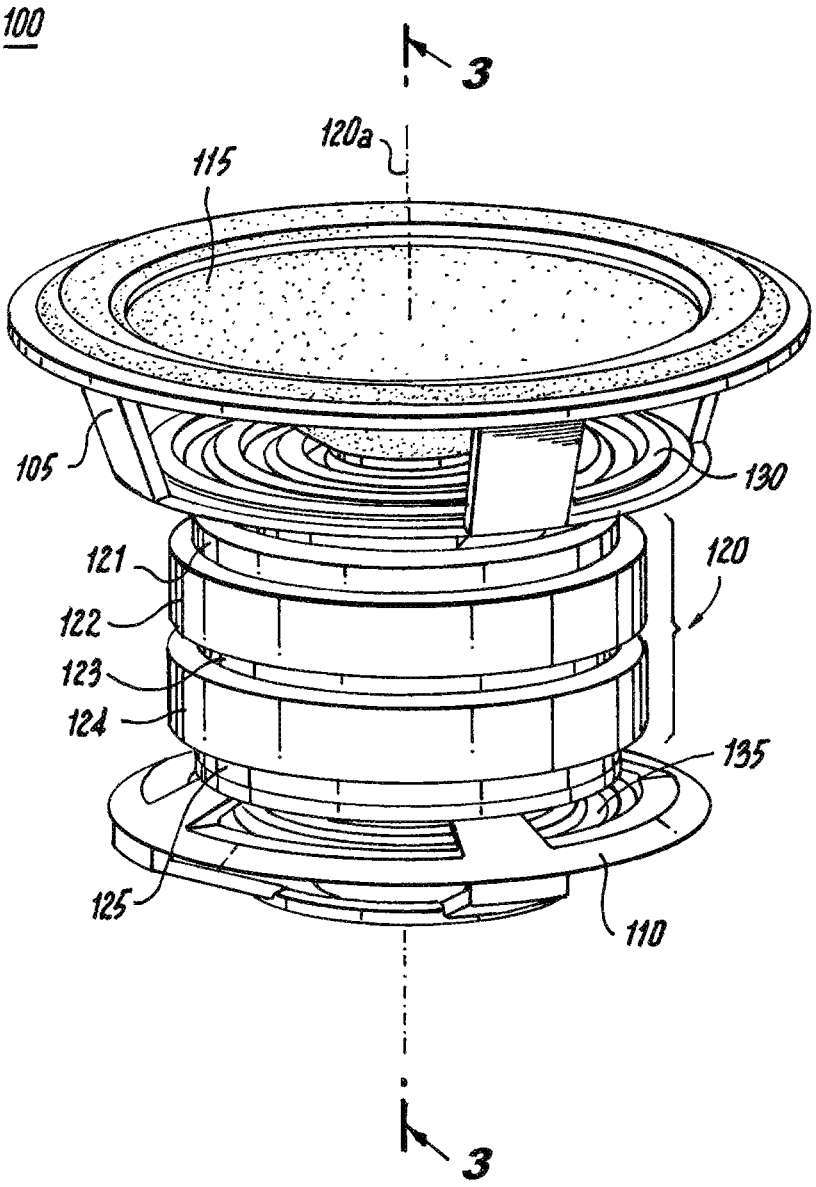
FIG. 1 illustrates an isometric perspective view of a speaker device assembly according to one exemplary embodiment of this disclosure.

For example, referring to the drawings, FIG. 1 particularly illustrates an isometric perspective view of a speaker device assembly 100 according to one exemplary embodiment of this disclosure.

As shown, speaker device assembly 100 has a structure including a top frame 105 and a bottom frame 110. Speaker device assembly 100 also includes a diaphragm 115 coupled to top frame 105 and a portion of a first voice coil assembly (not shown).

Speaker device assembly 100 further includes a magnetic core 120, including a top pole piece 121, a magnet 122, a center support 123, a magnet 124, and a bottom pole piece 125. Magnetic core 120 produces a magnetic field having one or more axes, such as axis 120*a*, that attracts or repels voice coils when the voice coils receive a corresponding electrical current.

As discussed in greater below, speaker device assembly 100 also includes two voice coil assemblies (not shown)—e.g., a first voice coil assembly and a second voice coil assembly. Operatively, the first voice coil assembly moves along an axis of the magnetic core 120 in response to an induced current to facilitate pressure variations in a medium to cause diaphragm 115 to vibrate at a particular frequency and produce sound waves. A suspension 130 (e.g., a spider suspension, etc.) is coupled to a portion of the first voice coil assembly, and guides the first voice coil assembly as it moves along axis 120*a*. A second voice coil assembly also moves along axis 120*a*, but in response to a reverse induced current (e.g., an opposite current relative to the induced current for first voice coil assembly), which causes the second voice coil assembly to move in a direction opposite to a direction of the first voice coil assembly. This opposing movement of the second voice coil assembly facilitates recoil vibration attenuation (e.g., producing a counter acting force) for speaker device assembly 100. That is, the second voice coil assembly provides a harmonically balanced differential vibration cancellation of recoil forces from the first voice coil assembly to thereby cancel re-radiation of the vibration (e.g., as unwanted noise) through and from the speaker device assembly 100. In addition, a suspension 135 is also coupled to the second voice coil assembly, and guides the second voice coil assembly as it moves along axis 120*a*.

Figure 2:
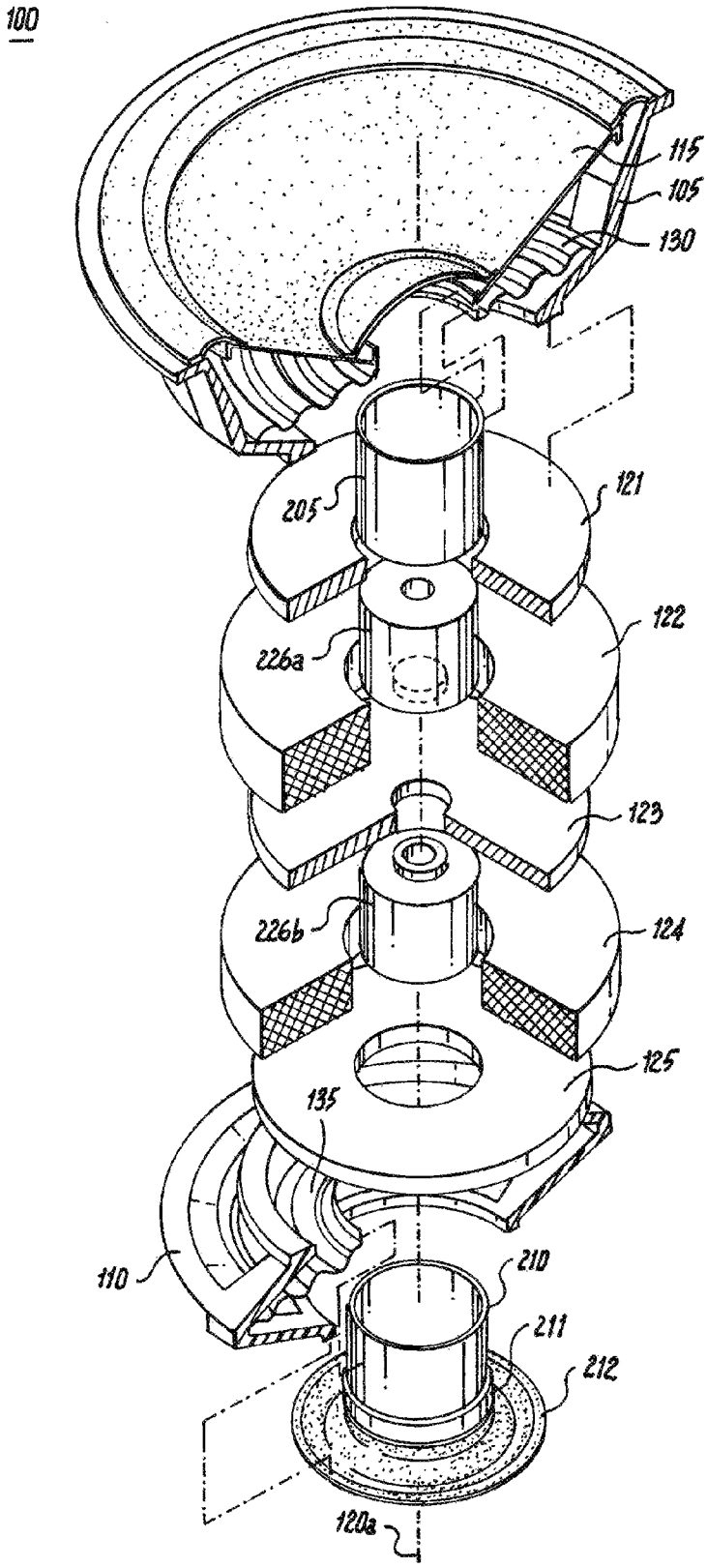
FIG. 2 illustrates an exploded perspective view of the speaker device assembly shown in FIG. 1.

FIG. 2 illustrates an exploded perspective view of speaker device assembly 100, and further shows two center pole pieces of magnetic core 120—center pole piece 226*a* and center pole piece 226*b*. Center pole piece 226*a* and center pole piece 226*b* are disposed, in part, interior to magnet 122 and magnet 124, respectively, and operatively focus or direct portions of the magnetic field of magnetic core 120.

As discussed above, speaker device assembly 100 includes two voice coil assemblies—namely, a voice coil assembly 205 and a voice coil assembly 210, with each voice coil assembly movable along axis 120*a*. In addition, voice coil assembly 210 also includes a counter balance 211 (e.g., a weight, etc.), and a suspension 212 (e.g., a rubber suspension member, etc.) coupled to bottom frame 110 of the speaker device assembly 100. Notably, voice coil assembly 205 and voice coil assembly 210 are illustrated for purposes of simplicity, not limitation. For example, each voice coil assembly can include or exclude various components such as insulated wire (e.g., a voice coil), various substrates (e.g., paper, aluminum, fiberglass, plastic, etc.) bonded to the wire, wire leads to induce a current, other electrical circuitry, and the like, as is understood by those skilled in the art.

Figure 3:
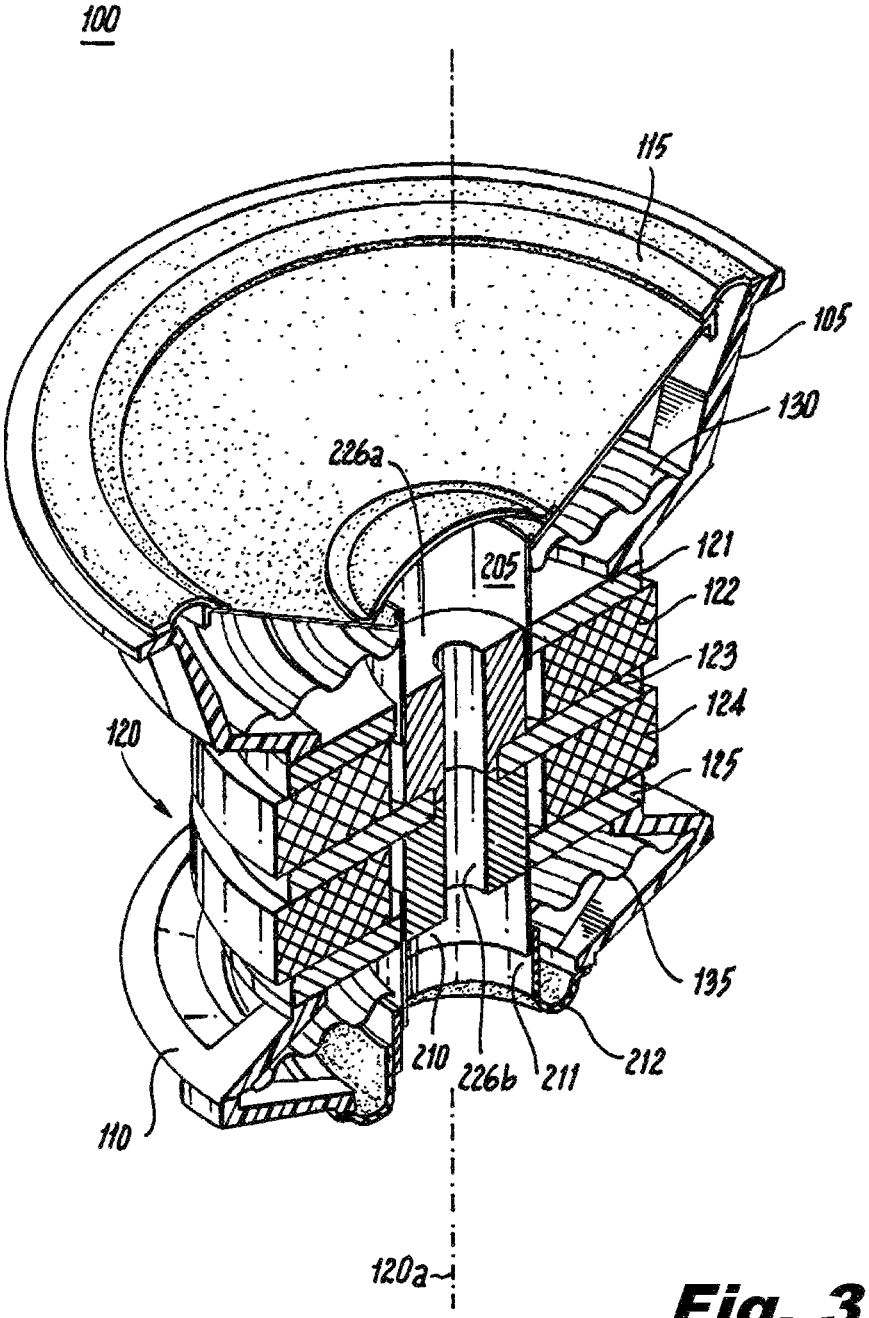
FIG. 3 illustrates a cross-sectional isometric perspective view of the speaker device assembly shown in FIG. 1, viewed from cut lines 3-3.

FIG. 3 illustrates a cross-sectional isometric perspective view of speaker device assembly 100, viewed from cut lines 3-3. In operation, speaker device assembly 100 translates electrical signals into pressure variations in a medium such as an audible sound in ambient air. Magnetic core 120 creates a magnetic field that interacts with a magnetic field associated with each voice coil assembly 205 and voice coil assembly 210 (e.g., caused by an electrical current). Specifically, a current is induced on each voice coil, which causes each voice coil to generate a corresponding magnetic field. The magnetic field for the corresponding voice coil assembly is attracted or repelled by the magnetic field of magnetic core 120, which causes the corresponding voice coil assembly to move along axis 120*a*. As discussed above, voice coil assembly 205 is coupled, in part, to diaphragm 115. Thus, when voice coil assembly 205 moves along axis 120*a*, voice coil assembly 205 causes diaphragm 115 to move or vibrate (e.g., produce sound, etc.).

However, voice coil assembly 205 may additionally cause recoil vibration to speaker device assembly 100 as it moves along axis 120*a*. Accordingly, a second voice coil assembly—e.g., voice coil assembly 210—is provided to attenuate such recoil vibration caused by voice coil assembly 205. In particular, voice coil assembly 210 operatively moves in a direction opposite to that of voice coil assembly 205 in response to a reverse induced current and attenuates the recoil vibration on speaker device assembly 100. For example, when voice coil assembly 210 moves along axis 120*a*, it transfers a counter vibration (e.g., a harmonically balanced differential vibration) to the speaker device assembly 100 using suspension 212.

Figure 4:
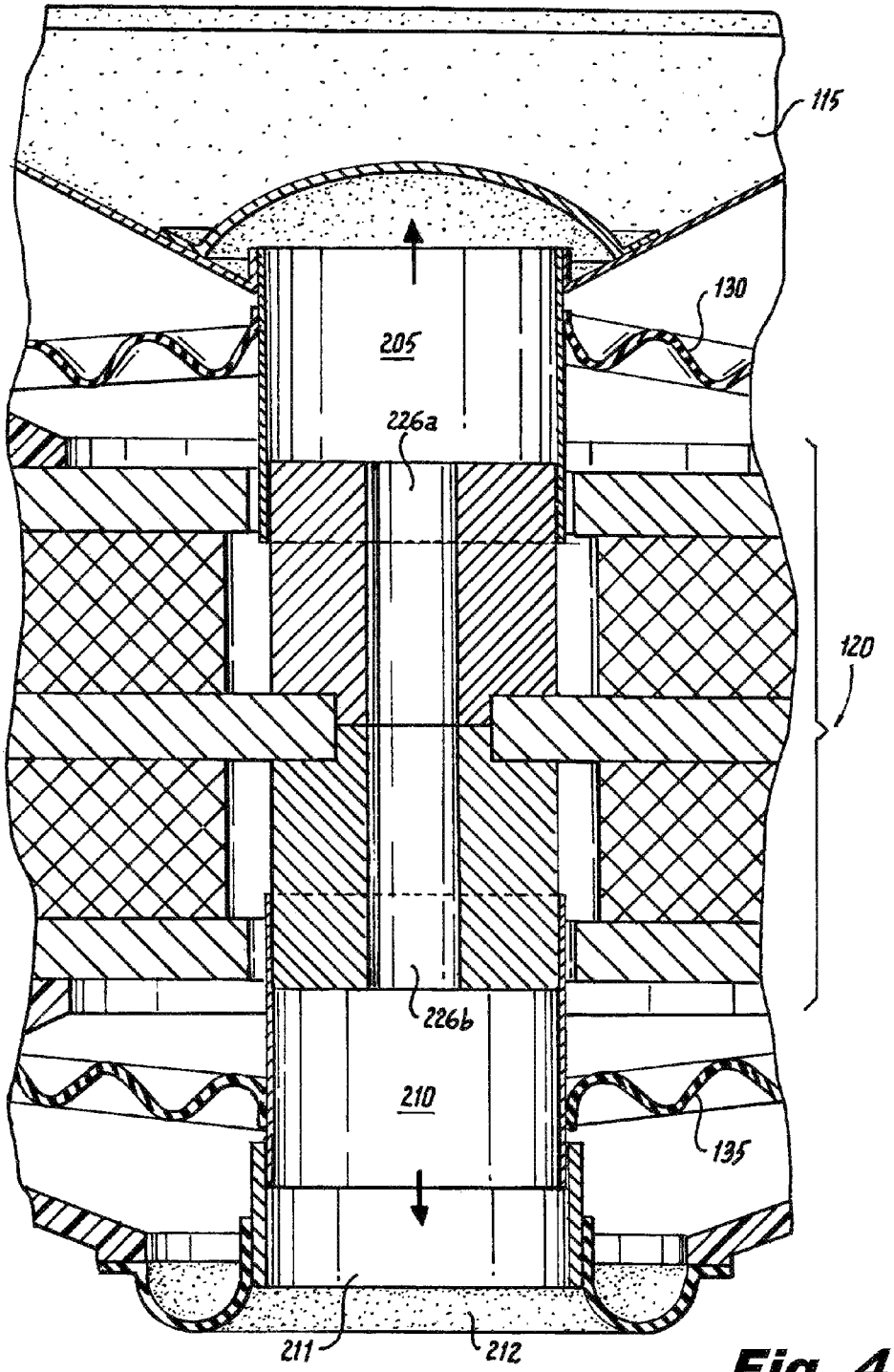
FIG. 4 illustrates a portion of a side elevation view for the cross-sectional view shown in FIG. 3, showing directional movement of a first voice coil in response to an induced current and movement of a second voice coil in response to a reverse induced current.
Figure 5:
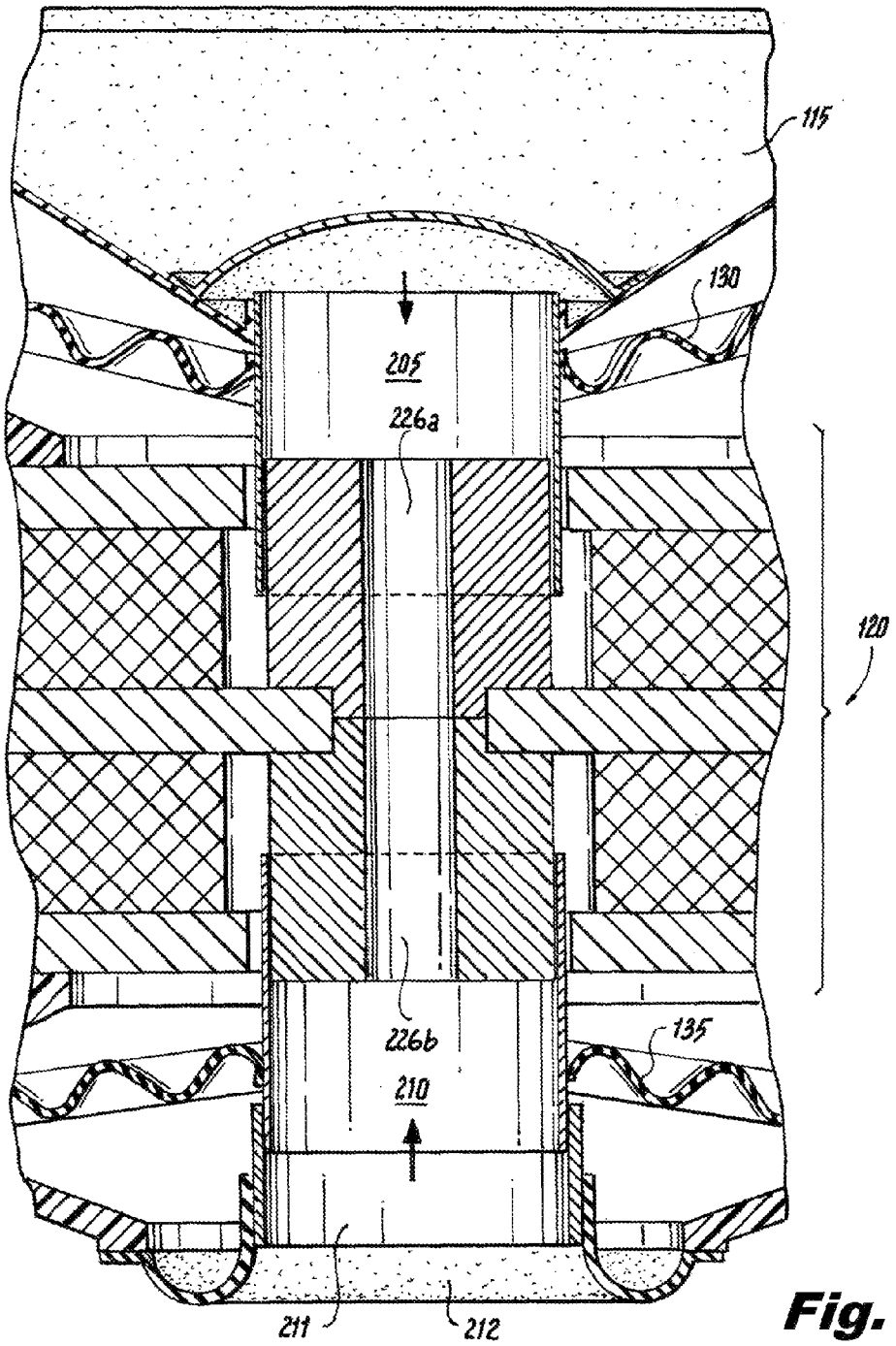
FIG. 5 illustrates a portion of a side elevation view for the cross-sectional view shown in FIG. 3, showing additional directional movement of the first voice coil and the second voice coil.

FIG. 4 and FIG. 5 illustrate a portion of a side elevation view corresponding to the cross-sectional view shown in FIG. 3, each showing relative directional movement for the voice coil assemblies—namely, in opposing directions. In both FIG. 4 and FIG. 5, the illustrated directional movement of voice coil assembly 205 is responsive to an induced current, while directional movement of voice coil assembly 210 is responsive to a reverse induced current.

For example, FIG. 4 shows a directional movement for voice coil assembly 205 and voice coil assembly 210 moving away from each other. In contrast, FIG. 5 shows a directional movement for voice coil assembly 205 and voice coil assembly moving toward each other.

As shown in FIG. 4 and FIG. 5, suspension 130 and suspension 135 each guide movement for voice coil assembly 205 and voice coil assembly 210, respectively, within the magnetic field of magnetic core 120 and along axis 120*a*. Importantly, counter balance 211 of voice coil assembly 210 accounts for a total moving mass of voice coil assembly 205 and determines, in part, an amount of attenuating force that voice coil assembly 210 can generate and transfer to speaker device assembly 100. Preferably, the mass for counter balance 211 is adjusted (e.g., increased or decreased) to equalize a total moving mass for voice coil assembly 210 relative to a total moving mass for voice coil assembly 205—e.g., the total moving mass for voice coil assembly 210 is the same or substantially identical to the total moving mass for voice coil assembly 205. For example, the mass for counter balance 211 can be adjusted to account for a mass of the medium (e.g., air) disposed between voice coil assembly 205 and diaphragm 115, a mass of suspension 130, and the like.

Further, although counter balance 211 is shown as a separate or independent component coupled to voice coil assembly 210, such view is for purposes of discussion, not limitation. In some embodiments, voice assembly 210 incorporates or otherwise integrates the mass of counter balance 211 in other voice coil assembly components using, for example, various manufacturing techniques (e.g., materials used, dimensions for voice assembly 210, and the like), as is appreciated by those skilled in the art.

According to the techniques discussed above, two voice coils assemblies are provided for a speaker device assembly—one voice coil assembly produces sound (but also causing unwanted vibration on the speaker device assembly), and the other voice coil assembly, moving in an opposing direction, attenuates the unwanted vibration. As is appreciated by those skilled in the art, these techniques as well as underlying design principles can be employed by various other embodiments.

Figure 6:
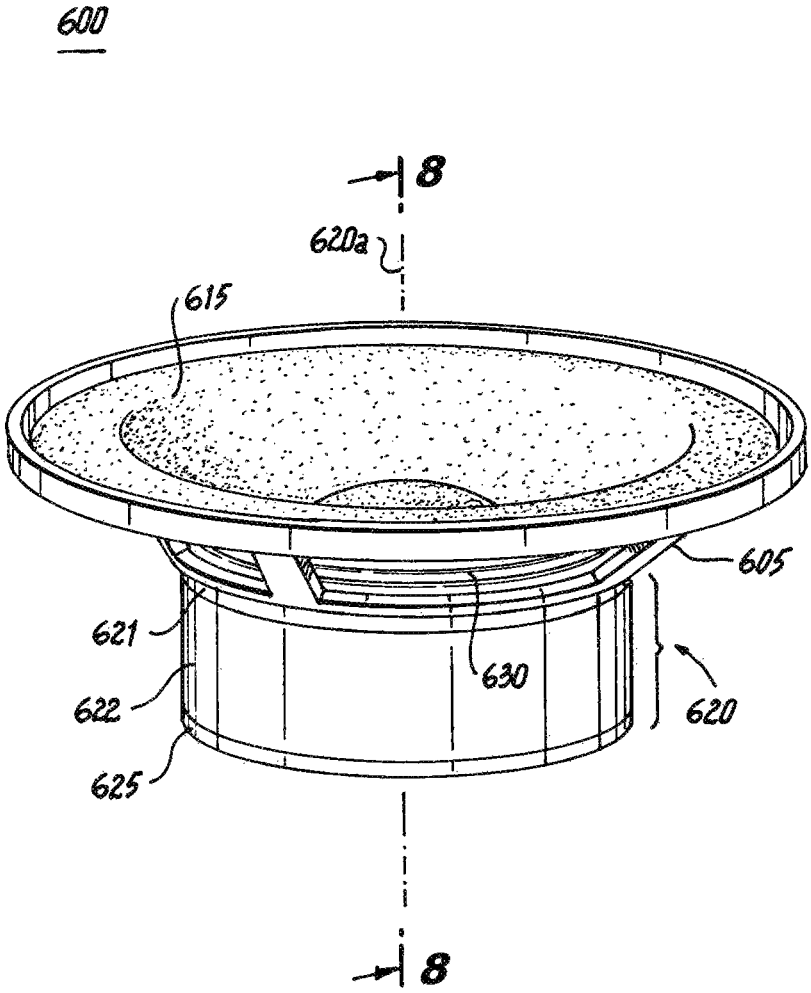
FIG. 6 illustrates an isometric perspective view of a speaker device assembly according to another exemplary embodiment of this disclosure.

For example, FIG. 6 illustrates an isometric perspective view of a speaker device assembly 600 according another exemplary embodiment. As shown, speaker device assembly 600 has a structure including a frame 605 coupled to a diaphragm 615. Diaphragm 615 is further is further coupled to a portion of a voice coil assembly (not shown)).

Speaker device assembly 600, similar to speaker device assembly 100, also includes a magnetic core 620. Magnetic core 620 includes a top pole piece 621, a magnet 622, and a bottom pole piece 625. Magnetic core 620 produces a magnetic field having one or more axes such as an axis 620*a*, and operatively attracts or repels a voice coil when the voice coil receives an electrical current.

Figure 7:
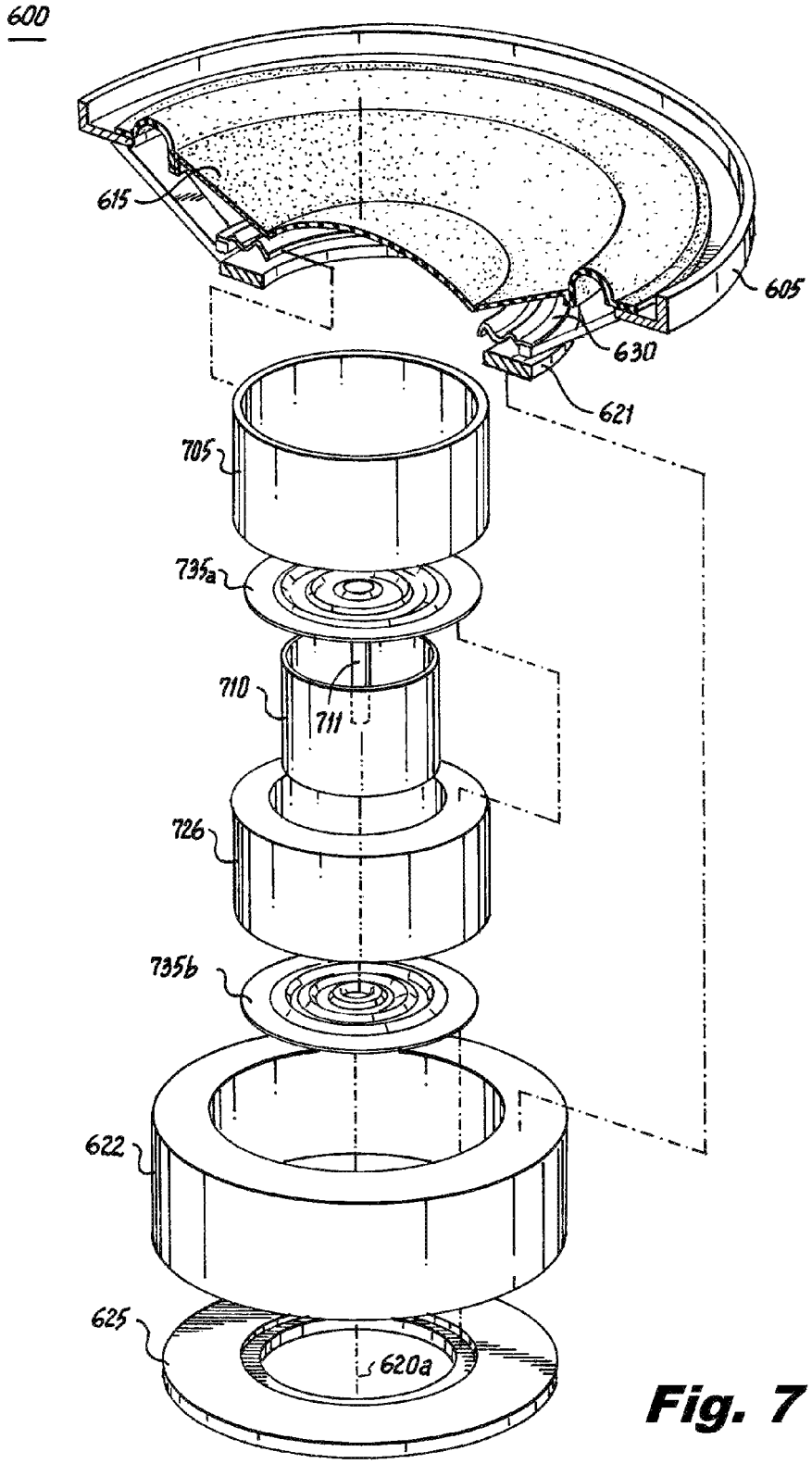
FIG. 7 illustrates an exploded perspective view of the speaker device assembly shown in FIG. 6.

FIG. 7 illustrates an exploded perspective view of speaker device assembly 600, showing a center pole piece 726 disposed interior to magnet 622. Center pole piece 726 operatively focuses or directs portions of a magnetic field of magnetic core 620. In addition, speaker device assembly 600 (similar to speaker device assembly 100) also includes two voice coil assemblies—a voice coil assembly 705 and a voice coil assembly 710, with each voice coil assembly movable along axis 620*a*.

As shown, voice coil assembly 710 includes a counter balance 711 disposed in a suspension assembly, and a suspension assembly having two suspensions 735*a*, 735*b* (e.g., spider suspensions). Suspension 735*a* is coupled to one side of center pole piece 726, and suspension 735*b* is coupled to an opposing side of center pole piece 726, with counter balance 711 disposed there-between. As discussed above, the views shown herein are for purposes of illustration, not limitation, and the voice coil assemblies can include or exclude any number of additional elements, as is appreciated by those skilled in the art.

Figure 8:
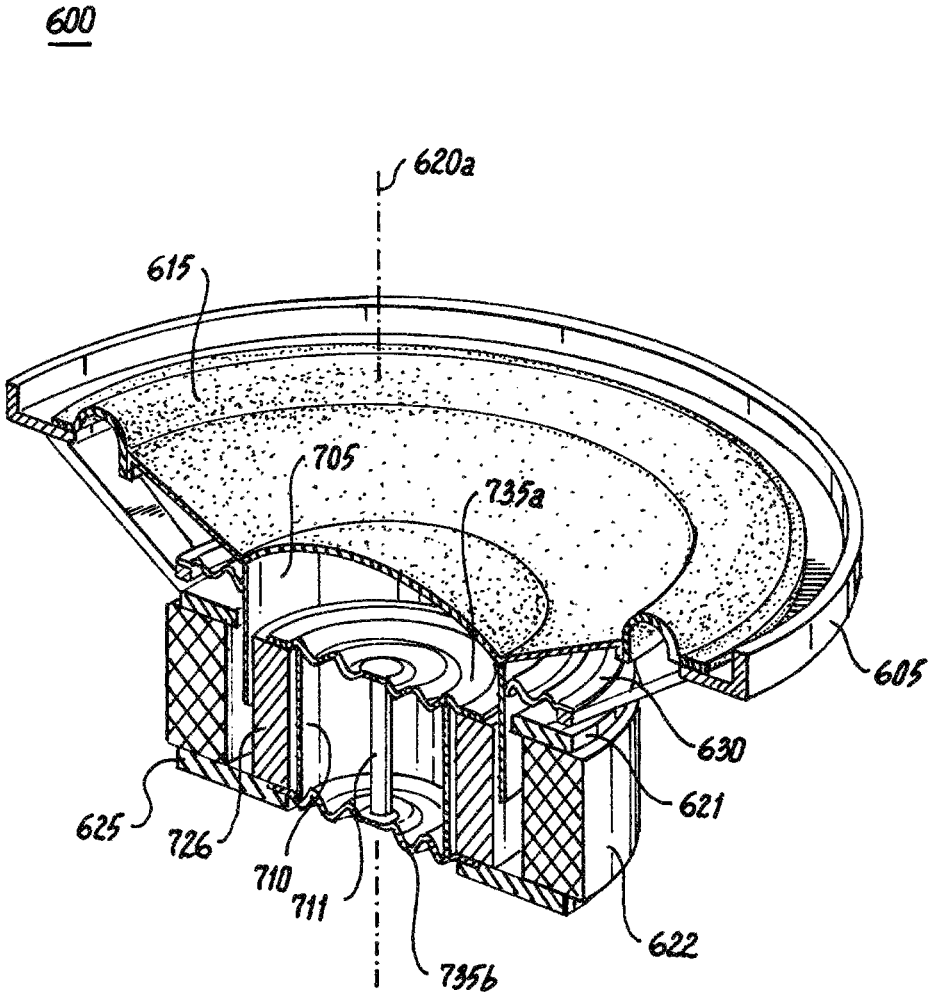
FIG. 8 illustrates a cross-sectional isometric perspective view of the speaker device assembly shown in FIG. 6, viewed from cut lines 8-8.

FIG. 8 illustrates a cross-sectional isometric perspective view of speaker device assembly 600, viewed from cut lines 8-8. In operation, speaker device assembly 800 translates electrical signals into pressure variations in a medium, such as an audible sound in ambient air. Magnetic core 620 creates a magnetic field that interacts with a magnetic field associated with each voice coil assembly 705 and voice coil assembly 710. As discussed above, a current is induced on each voice coil assembly, which causes each voice coil assembly to generate a corresponding magnetic field. The magnetic field for the corresponding voice coil assembly is attracted or repelled by the magnetic field of magnetic core 620, which causes the corresponding voice coil assembly to move along axis 620*a*. As discussed above, voice coil assembly 705 is coupled, in part, to diaphragm 615. Thus, when voice coil assembly 705 moves along axis 720*a*, voice coil assembly 705 also causes diaphragm 615 to move or vibrate (e.g., produce sound, etc.).

However, voice coil assembly 705 may additionally cause vibration to speaker device assembly 600 when it moves along axis 620*a*. Accordingly, a second voice coil assembly—namely, voice coil assembly 710—is provided to attenuate the vibration caused by voice coil assembly 705. In particular, voice coil assembly 710 operatively moves in a direction opposite to that of voice coil assembly 705 in response to a reverse induced current in order to attenuate the vibration on speaker device assembly 600. For example, when voice coil assembly 710 moves along axis 620*a*, it transfers a counter acting force (e.g., a counter vibration) to the speaker device assembly 600 using suspension 712. Put differently, movement of voice coil assembly 710 provides a canceling force (e.g., a harmonically balanced differential vibration) for the speaker device assembly 600, which cancels unwanted vibration (e.g., recoil force) in the structure of speaker device assembly 600.

Figure 9:
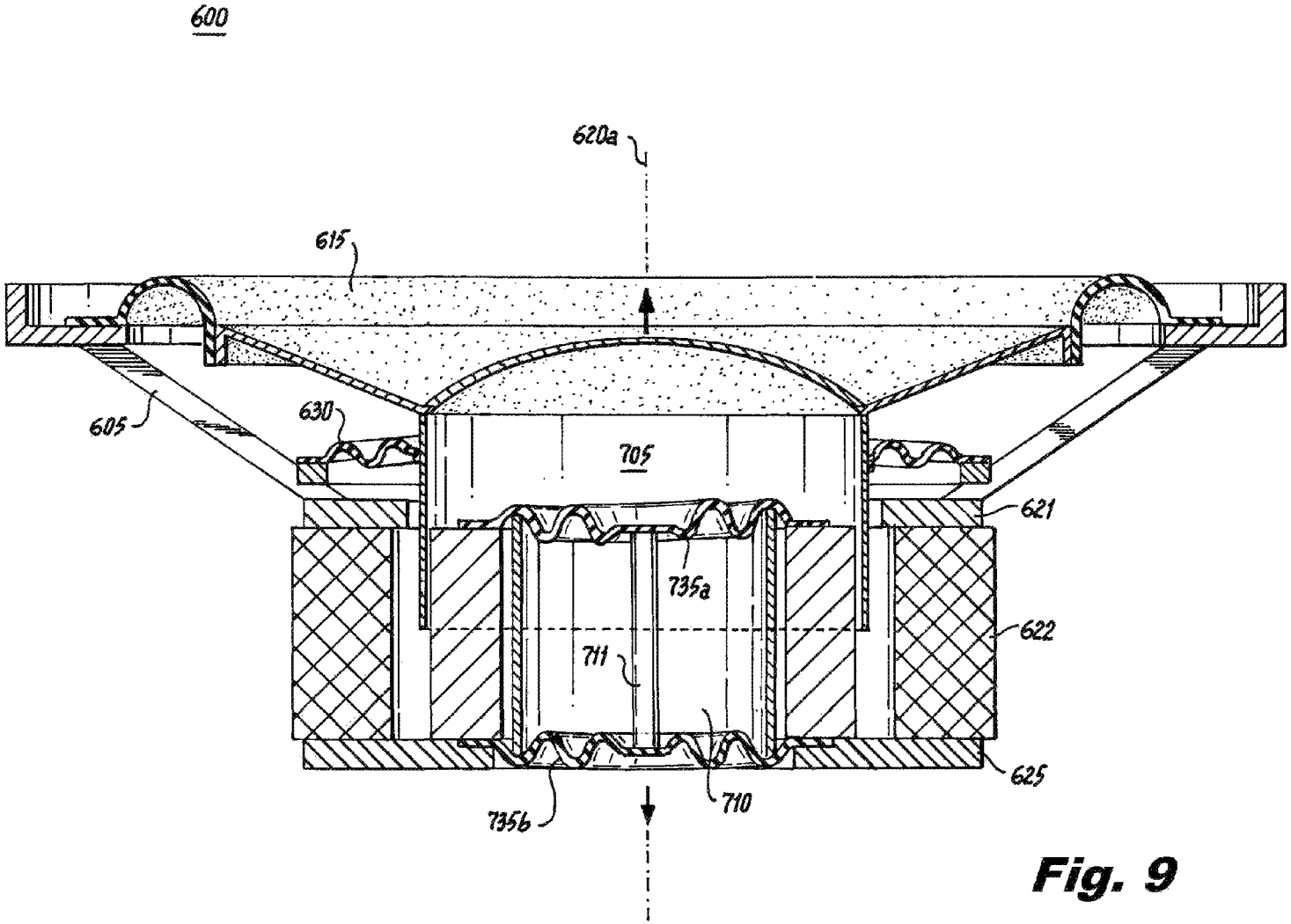
FIG. 9 illustrates a cross-sectional side elevation view of the speaker device assembly shown in FIG. 8, showing directional movement of a first voice coil in response to an induced current and movement of a second voice coil in response to a reverse induced current.
Figure 10:
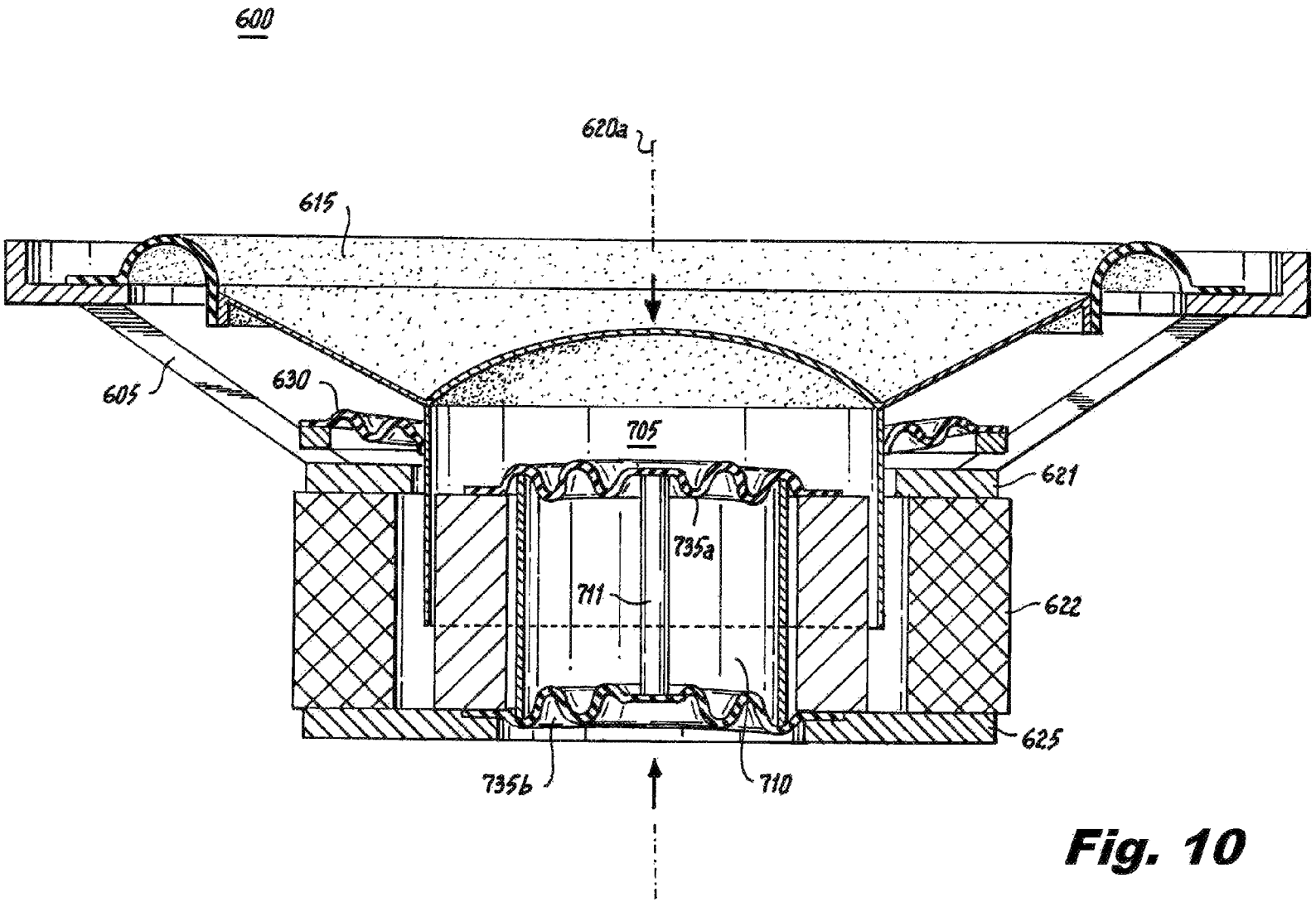
FIG. 10 illustrates a cross-sectional side elevation view of the speaker device assembly shown in FIG. 8, showing additional directional movement of the first voice coil and the second voice coil.

FIG. 9 and FIG. 10 illustrate a portion of a side elevation view corresponding to the cross-sectional view shown in FIG. 8, each showing relative directional movement for the voice coil assemblies—e.g., in opposing directions. In FIG. 9 and FIG. 10, the illustrated directional movement of voice coil assembly 705 is responsive to an induced current, and directional movement of voice coil assembly 710 is responsive to a reverse induced current.

For example, FIG. 9 shows a directional movement for voice coil assembly 705 and voice coil assembly 710 moving away from each other. In contrast, FIG. 10 shows a directional movement for voice coil assembly 705 and voice coil assembly moving toward each other.

As shown in FIG. 9 and FIG. 10, suspension 630 and the suspension assembly, including suspensions 735*a*, 735*b*, guide movement for voice coil assembly 705 and voice coil assembly 710, respectively, within the magnetic field of magnetic core 620 and along axis 620*a*. Importantly, counter balance 711 accounts for a total moving mass of voice coil assembly 705 and determines, in part, the amount of attenuating force that voice coil assembly 710 can generate and transfer to speaker device assembly 600. Preferably, the mass for counter balance 711 is adjusted (e.g., increased or decreased) to equalize a total moving mass for voice coil assembly 710 relative to a total moving mass for voice coil assembly 705—e.g., the total moving mass for voice coil assembly 710 is the same or substantially identical to the total moving mass for voice coil assembly 705. For example, the mass for counter balance 711 can be adjusted to account for a mass of the medium (e.g., air) disposed between voice coil assembly 705 and diaphragm 615, a mass of suspension 630, and the like.

Further, although counter balance 711 is shown as a separate or independent component (e.g., a center bar) disposed between the suspension assembly (which includes suspensions 735*a*, 735*b*), such view is for purposes of discussion, not limitation. For example, counter balance 711 (similar to counter balance 211) can be incorporated and/or integrated into various other components of voice coil assembly 710 using various manufacturing techniques, as is appreciated by those skilled in the art.

The techniques and devices described herein, therefore, provide improvements for noise attenuation, particularly adapted for acoustic devices, including speaker device assemblies. Such techniques and devices cancel unwanted mechanical vibration from speaker drivers (e.g., noise), and provide a simple, low cost solution—e.g., using a second voice coil assembly having an appropriate counter balance mass provides a simple mechanical solution that does not require any acoustical radiation. The techniques and devices can be implemented, for example, for any speaker assembly, and further obviate the need for gaskets, rubber bushings, and extensive use of bracing. Further, such techniques and devices provide noise attenuation throughout a responsive frequency range.

While there have been shown and described illustrative embodiments that attenuate unwanted vibration for speaker device assemblies, it is to be understood that various other adaptations and modifications may be made within the spirit and scope of the embodiments herein. For example, the embodiments have been shown and described herein with relation to two exemplary embodiments, with the voice coil assemblies shown in a particular arrangement. However, the embodiments in their broader sense are not as limited, and may, in fact, be used with various other types of designs and implementations. Accordingly, it will be apparent, however, that other variations and modifications may be made to the described embodiments, with the attainment of some or all of their advantages. For instance, it is expressly contemplated that the components and/or elements described herein can be implemented.

What is claimed is:

1. A speaker device assembly, comprising:

a first voice coil assembly moveable along an axis of a magnetic field of a magnetic core responsive to an induced current to facilitate pressure variations in a medium, and cause recoil vibration on a speaker assembly structure; and a second voice coil assembly having a counter balance mass that accounts for at least a mass of the first voice coil assembly, and moveable along the axis of the magnetic field in a direction opposite the first voice coil assembly to attenuate the recoil vibration on the speaker assembly structure, when the first voice coil assembly moves along the axis of the magnetic field.

2. The speaker device assembly of claim 1, wherein the second voice coil assembly moves along the axis of the magnetic field opposite the first voice coil assembly responsive to a reverse induced current.

3. The speaker device assembly of claim 1, wherein the counter balance mass further accounts for a mass of at least a portion of a diaphragm of the speaker device assembly, and at least a portion of the medium disposed between the diaphragm and the first voice coil assembly.

4. The speaker device assembly of claim 1, wherein the second voice coil assembly further includes a suspension coupled to a portion of the speaker assembly structure, the suspension transfers movement of the second voice coil assembly to the portion of the speaker assembly structure to attenuate the recoil vibration on the speaker assembly structure.

5. The speaker device assembly of claim 1, further comprising:

a first suspension coupled to the first voice coil assembly and a portion of the speaker assembly structure, the first suspension guides the first voice coil assembly when the first voice coil moves along the axis of the magnetic field.

6. The speaker device assembly of claim 5, further comprising:

a second suspension coupled to the second voice coil assembly and a portion of the speaker assembly structure opposite the first suspension, the second suspension guides the second voice coil assembly when the second voice coil moves along the axis of the magnetic field in the direction opposite the first voice coil assembly.

7. The speaker device assembly of claim 5, further comprising:

a center pole piece disposed, at least in part, interior to the magnetic core, the center pole piece operable to direct at least a portion of a magnetic field of the magnetic core, and a second suspension assembly including a first spider suspension coupled to one side of the center pole piece and a portion of the second voice coil assembly, a second spider suspension coupled to another side of the center pole piece and a portion of the second voice coil assembly, and a counter balance weight coupled to each of the first spider suspension and the second spider suspension, the counter balance weight including the counter balance mass.

8. The speaker device assembly of claim 5, wherein the first suspension is a spider suspension.

9. The speaker device assembly of claim 1, further comprising:

a center pole piece disposed, at least in part, interior to the magnetic core, the center pole piece focuses at least a portion of a magnetic field associated with the magnetic core.

10. A speaker device assembly comprising:

a housing structure having at least a first side and a second side, opposite the first side;

a magnetic core disposed between the first side and the second side of the housing structure, the magnetic core generates a magnetic field;

a first voice coil assembly proximate the first side of the housing structure, and moveable along an axis of the magnetic field of the magnetic core responsive to an induced current to facilitate pressure variations in a medium, and cause recoil vibration on the housing structure;

a diaphragm coupled to the first side of the housing structure and at least a portion of the first voice coil assembly, the first voice coil assembly moves at least the portion of the diaphragm to facilitate the pressure variations in the medium;

a second voice coil assembly proximate the second side of the housing structure and having a counter balance mass that accounts for at least a moving mass of the first voice coil assembly, the second voice coil assembly moveable along the axis of the magnetic field of the magnetic core in a direction opposite to the first voice coil assembly to attenuate the recoil vibration on the speaker assembly structure, when the first voice coil assembly moves along the axis of the magnetic core.

11. The speaker device assembly of claim 10, wherein the second voice coil moves along the axis of the magnetic field opposite the first voice coil assembly responsive to a reverse induced current.

12. The speaker device assembly of claim 10, wherein the counter balance mass further accounts for a mass of at least a portion of the diaphragm, and at least a portion of the medium disposed between the diaphragm and the first voice coil assembly.

13. The speaker device assembly of claim 10, wherein the second voice coil assembly further includes a suspension coupled to a portion of the speaker assembly structure proximate the second side, the suspension translates movement of the second voice coil assembly to the portion of the speaker assembly structure proximate the first side to attenuate the recoil vibration on the speaker assembly structure.

14. The speaker device assembly of claim 10, further comprising:

a first suspension coupled to the first voice coil assembly and a portion of the speaker assembly structure proximate the first side, the first suspension guides the first voice coil assembly when the first voice coil moves along the axis of the magnetic field.

15. The speaker device assembly of claim 14, further comprising:

a second suspension coupled to the second voice coil assembly and a portion of the speaker assembly structure proximate the second side, the second suspension guides the second voice coil assembly when the second voice coil moves along the axis of the magnetic field in the direction opposite the first voice coil assembly.

16. The speaker device assembly of claim 10, further comprising:

a center pole piece disposed, at least in part, interior to the magnetic core, the center pole piece focuses at least a portion of a magnetic field associated with the magnetic core.

17. A speaker device assembly comprising:

a housing structure;

a magnetic core that generates a magnetic field;

a first voice coil assembly moveable along an axis of the magnetic field of the magnetic core responsive to an induced current to facilitate pressure variations in a medium, and cause recoil vibration on the housing structure;

a diaphragm coupled to the housing structure and at least a portion of the first voice coil assembly, the first voice coil assembly moves at least the portion of the diaphragm to facilitate the pressure variations in the medium;

a second voice coil assembly disposed interior to magnetic core and interior to at least a portion of the first voice coil assembly, the second voice coil assembly moveable along the axis of the magnetic field of the magnetic core in a direction opposite to the first voice coil assembly, when the first voice coil assembly moves along the axis of the magnetic core.

a counter balance coupled to the second voice coil assembly, and having a mass accounting for at least a moving mass of the first voice coil assembly, the counter balance and the second voice coil cooperate to attenuate the recoil vibration on the speaker assembly structure.

18. The speaker device assembly of claim 17, wherein the second voice coil assembly moves along the axis of the magnetic field opposite the first voice coil assembly responsive to a reverse induced current.

19. The speaker device assembly of claim 17, wherein the second voice coil assembly further includes a suspension coupled to a portion of the speaker assembly structure, the suspension transfers movement of the second voice coil assembly to the portion of the speaker assembly structure to attenuate the recoil vibration on the speaker assembly structure.

20. The speaker device assembly of claim 17, further comprising:

a center pole piece disposed, at least in part, interior to the magnetic core, the center pole piece operable to direct at least a portion of a magnetic field of the magnetic core, and a second suspension assembly including a first spider suspension coupled to one side of the center pole piece and a portion of the second voice coil assembly, a second spider suspension coupled to another side of the center pole piece and a portion of the second voice coil assembly, and a counter balance weight coupled to each of the first spider suspension and the second spider suspension, the counter balance weight including the counter balance mass.

* * * * *